US006202515B1

(12) United States Patent
Denton

(10) Patent No.: US 6,202,515 B1
(45) Date of Patent: Mar. 20, 2001

(54) WRENCH WITH QUICK RELEASE HANDLE

(76) Inventor: Sandra L. Denton, P.O. Box 720700, Pinon Hills, CA (US) 92372

( * ) Notice: Subject to any disclaimer, the term of this patent is extended or adjusted under 35 U.S.C. 154(b) by 0 days.

(21) Appl. No.: 09/325,973

(22) Filed: Jun. 4, 1999

(51) Int. Cl.[7] ..... B25B 23/16
(52) U.S. Cl. ..... 81/177.1; 81/119
(58) Field of Search ..... 81/177.1, 119, 81/177.85, 489

(56) References Cited

U.S. PATENT DOCUMENTS 120,304 * 10/1871 McBride ..... 81/119
1,415,826 * 5/1922 Finkhousen ..... 81/119
1,626,906 * 5/1927 Zilliox ..... 81/119
4,063,472 * 12/1977 MacIntyre et al. ..... 81/3 R
5,562,006 * 10/1996 Pelosi, Jr. et al. ..... 81/119

* cited by examiner

*Primary Examiner*—David A. Scherbel
*Assistant Examiner*—Daniel Shanley
(74) *Attorney, Agent, or Firm*—Kit M. Stetina; Stetina Brunda Garred & Brucker

(57) ABSTRACT

A wrench with a quick release handle for providing torque to a fastener. The wrench comprises a wrench head having a retention opening for engaging the fastener and at least two engagement portions for attachment of a releasable handle thereat. The retention opening includes and open end for allowing the wrench head to be laterally extensible over the fastener. The engagement portion of the wrench head includes a head channel that can receive a corresponding handle lip disposed on the handle in order facilitate engagement between the wrench head and the handle. Additionally, the handle further includes a locking mechanism for maintaining releasable attachment between the wrench head and the handle.

14 Claims, 2 Drawing Sheets

WRENCH WITH QUICK RELEASE HANDLE

FIELD OF THE INVENTION

The present invention generally relates to wrenches and more specifically to a wrench head with a detachable handle that can be used for engaging hex heads in confined spaces.

BACKGROUND OF THE INVENTION

Currently, conventional open end wrenches are ideal for engaging a nut or bolt head (e.g., hex head) wherein a socket cannot be engaged thereover because access to the hex head is limited. However, a drawback to such open end wrenches is that the handle is attached to the wrench head thereby making engagement with the hex head difficult. As such, the conventional open end wrench is difficult to use when the hex head to be tightened or released is in a confined space. Specifically, the wrench will have to be removed from the hex head when the handle cannot be moved due to the limited area in which to swing the handle. Therefore, tightening or releasing a hex head can be a tedious process with a conventional open end wrench because the wrench will need to be removed from the hex head and then re-engaged in order to provide torque to the hex head. Additionally as previously discussed, it can be difficult to engage the hex head with a conventional open end wrench because the opening of the wrench must be rotationally aligned with the hex head for proper engagement. Therefore, removing an open end wrench from the hex head during torquing is not advantageous because it is difficult to rotationally re-align the wrench with the hex head.

The present invention addresses the deficiencies of prior art open end wrenches by providing a wrench that comprises a handle detachable from a wrench head. The wrench head includes a plurality of engagement positions for the handle such that the wrench head does not need to be removed from the nut during torquing. The handle can be removed from the wrench head and easily engaged to any one of a plurality of engagement positions in order to torque a hex head in a confined space. Additionally, the wrench head of the present wrench is easily engagable to the hex head due to its compact size and detachable handle.

SUMMARY OF THE INVENTION

In accordance with the preferred embodiment of the present invention there is provided a wrench for use with a fastener. The wrench comprises a wrench head having a retention opening for engaging the fastener and at least two engagement portions. Furthermore the wrench comprises an elongate handle releasably attachable to the wrench head at any one of the engagement portions. The wrench head may comprise three engagement portions equidistantly spaced at intervals of about 50 degrees to 55 degrees.

The wrench constructed in accordance with the preferred embodiment may further include an open end at the retention opening for allowing the wrench head to be laterally extensible over the fastener. Additionally, the retention opening may define four sides which corresponding to the sides of the fastener which may be a six-sided hex head.

In accordance with the preferred embodiment of the present invention, the engagement portion of the wrench head may include a recessed head channel. As such, the handle will further include a handle lip which is receivable into the channel of the engagement portion to facilitate releasable attachment of the handle to the wrench head. Furthermore, the handle may include a handle channel and each of the engagement portions may include head lip which is receivable into the handle channel to facilitate releasible attachment of the wrench head to the handle. In order to assist in maintaining the handle in releasable attachment to the wrench head, the handle may further comprises a locking mechanism. The locking mechanism includes a biasing spring disposed within the channel and a friction member disposed on one end of the biasing spring and normally biased against the head lip of one of the engagement portions.

The present invention further comprises a method of providing torque to a fastener with a wrench. The wrench includes a wrench head having a retention opening for engaging the fastener and at least two engagement portions, and a handle which is attachable to the wrench head at any one of the engagement positions thereof. The method comprises the steps of placing the fastener within the retention opening, attaching the handle to one of the engagement portions, and then rotating the handle to provide torque to the fastener. If the swing range of the handle is limited, then the handle is released from the wrench head and attached to a another one of the engagement portions of the wrench head in order to further rotate the handle.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
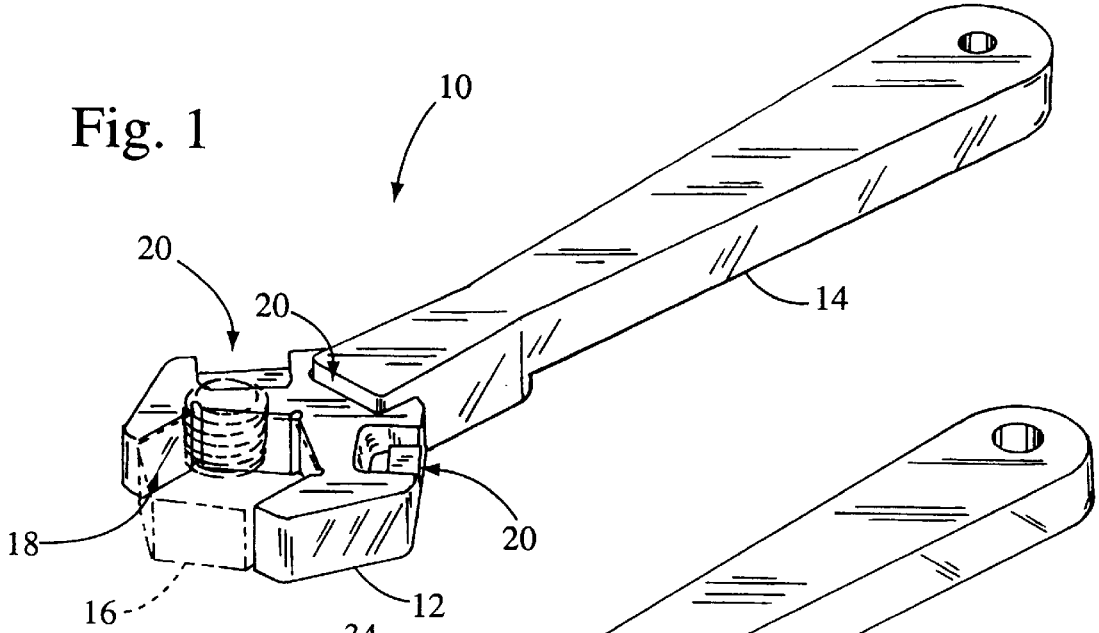
FIG. 1 is a top perspective view of the wrench constructed in accordance with the preferred embodiment of the present invention as used with a hex head fastener.

Referring now to the drawings wherein the showings are for purposes of illustrating a preferred embodiment of the present invention only, and not for purposes of limiting the same, FIG. 1 perspectively illustrates a wrench 10 constructed in accordance with the preferred embodiment of the present invention. The wrench 10 comprises a metallic wrench head 12 and a metallic, detachable handle 14. The wrench 10 is used for providing torque to a six-sided hex head fastener such as a nut 16 or the head of a bolt (not shown). As seen in FIG. 1, the wrench head 12 partially bounds the outside circumference of the nut 16 with a hex head retention opening 18 similar to a conventional open ended wrench. As such, the wrench head 12 can be sized to be laterally extensible over standard, metric, and english sized hex head fasteners.

Figure 4:
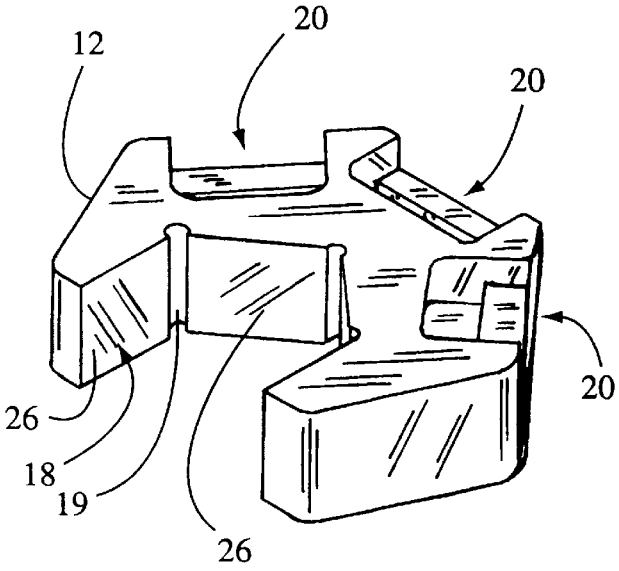
FIG. 4 is a top perspective view of the wrench head for the wrench of the present invention.
Figure 5:
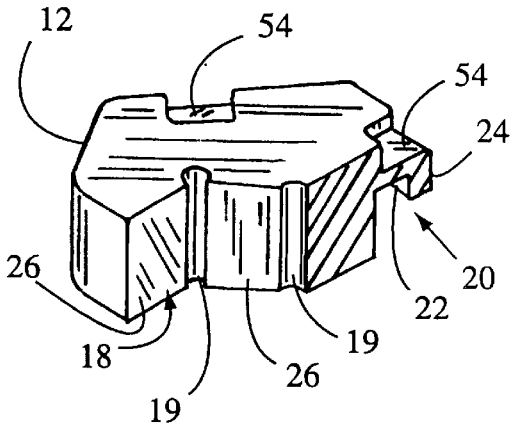
FIG. 5 is a bottom cut-away perspective view of the wrench head shown in FIG. 2.

The hex head retention opening 18 frictionally engages the nut 16 during torquing. As seen in FIGS. 4 and 5, the retention opening 18 comprises four end-to-end walls 26 sized and configured to be slightly larger than four corresponding faces of the nut 16 to be tightened or loosened. As such, the wrench head 12 will remain in frictional engagement on the nut 16 during removal of the handle 14 as will be explained in greater detail below. Additionally, the retention opening 18 may be provided with tubular grooves 19 between each pair of walls 26 for preventing the corners of the nut 16 from being worn during rotation of the wrench head 12.

The wrench 10 is designed to be used in situations where the swing range of the handle 14 is limited due to an obstruction such as often occurs when working on an engine of an automobile. When the swing range of the handle 14 is limited, it is desirable to tighten or loosen the nut 16 without having to remove the wrench head 12 from nut 16 in order to avoid alignment difficulties. Therefore, the handle 14 is detachable from wrench head 12 and can be placed at any one of three separate engagement portions 20 of the wrench head 12. As best seen in FIG. 4, the wrench head 12 comprises three engagement portions 20 that are each operative to releasably couple handle 14 to wrench head 12 for torquing. Therefore, in order to use the wrench 10 in situations where the swing range of handle 14 is limited, the wrench head 12 is placed over the nut 16 in a position whereby handle 14 engages any one of the engagement portions 20. Then the handle 14 is turned to apply torque to the nut 16 via the wrench head 12. When the swing range of handle 14 is limited, it is disengaged from wrench head 12 and re-engaged at a different engagement portion 20 to allow the handle 14 to be swung. As such, the geometry of the wrench head 12 allows the handle 14 to be swung further than a conventional open ended wrench thereby reducing the need to remove the wrench head 12 from the nut 16.

As can be seen in FIG. 4, the engagement portions 20 are positioned partially around the outside surface of the wrench head 12 in equidistantly spaced intervals of about 50 to 55 degrees. Therefore, as the wrench head 12 is rotated, the handle is engagable to an engagement portion 20 that will allow the handle to swing in order to provide torque. However, when the wrench head 12 has been rotated to a position wherein the handle cannot engage any engagement portion 20, then the wrench head 12 must be removed from the nut 16 and rotated to engage the nut 16 at a position whereby the handle 14 can couple with one of the engagement portions 20 and still be able to swing to provide torque thereto. As previously mentioned, the geometry of the spacing between the portions 20 mitigates the need to remove the wrench head 12 from the nut 16. As will be recognized, the number and spacing of the engagement portions 20 may vary depending upon the size of handle 14 and wrench head 12.

As seen in FIG. 5, a cross-sectional view of the wrench head 12, each engagement portion 20 comprises a wrench head channel 22 and a wrench head lip 24. The wrench head channel 22 and lip 24 are sized and configured such that they can engage a complementary structure on the handle 14 as will be described in greater detail below. The wrench head channel 22 is a generally rectangularly shaped recess and the wrench head lip 24 is disposed adjacent thereto. The wrench head lip 24 is also generally rectangular and has substantially the same dimensions as the channel 22. However, the lip 24 projects upward from the base of the channel 22 a distance that allows the handle 14 to engage the wrench head 12 as seen FIG. 1. It will be recognized by those of ordinary skill in the art, that each engagement portion 20 does not necessarily need to be rectangular, but can be any shape or size that will facilitate the engagement and easy removal of handle 14 from wrench head 12.

Figure 6:
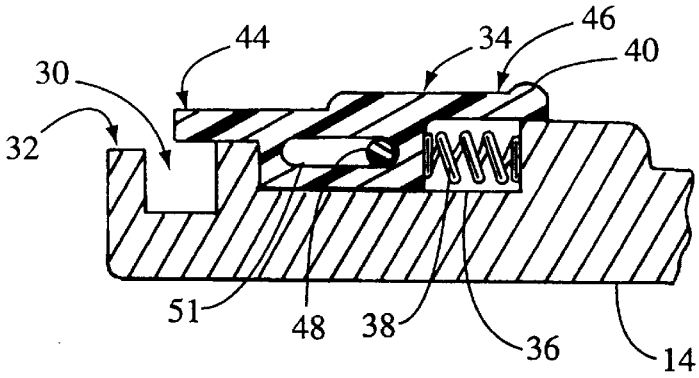
FIG. 6 is a partial cross-sectional view taken along line 6—6 of FIG. 3.

In the preferred embodiment of the present invention, the elongate handle 14 is formed to engage the wrench head 12 at any engagement portion 20. Therefore, as seen in FIG. 6, the head 28 of handle 14 is formed with a handle channel 30 and a handle lip 32. The handle lip 32 is sized and configured to be receivable into the wrench head channel 22 of the engagement portion 20. Additionally, it is contemplated that the wrench head lip 24 is sized and configured complementary to the handle channel 30 such that wrench head lip 24 is receivable into handle channel 30. Therefore, as seen in FIG. 1, the handle 14 is engaged to the wrench head 12 when wrench head lip 24 is received into the handle channel 30 concurrently with the receipt of handle lip 32 into wrench head channel 22.

Figure 2:
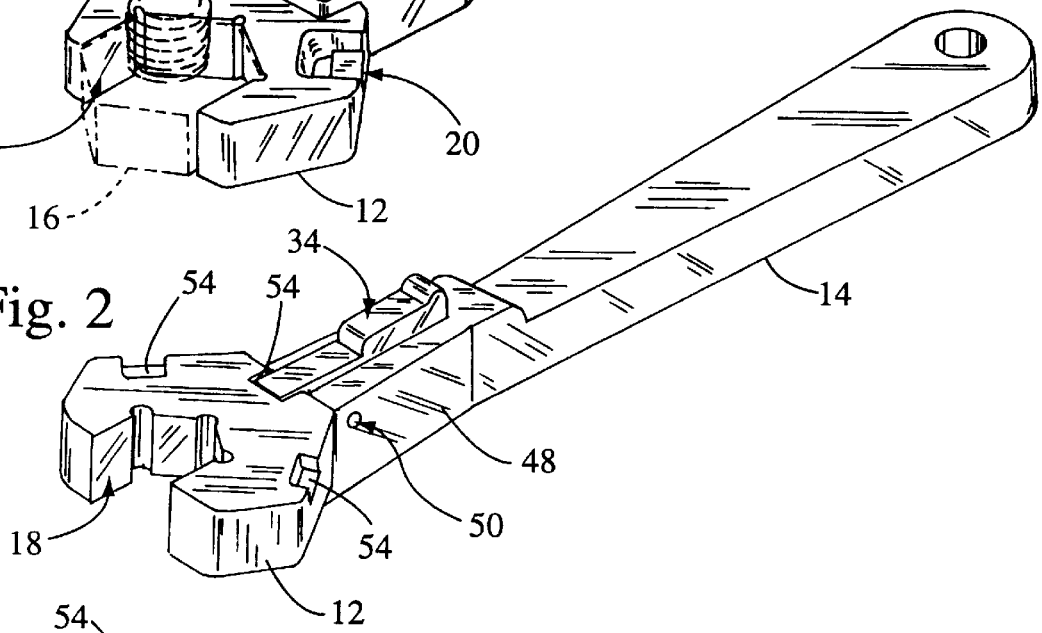
FIG. 2 is a bottom perspective view of the wrench shown in FIG. 1.
Figure 3:
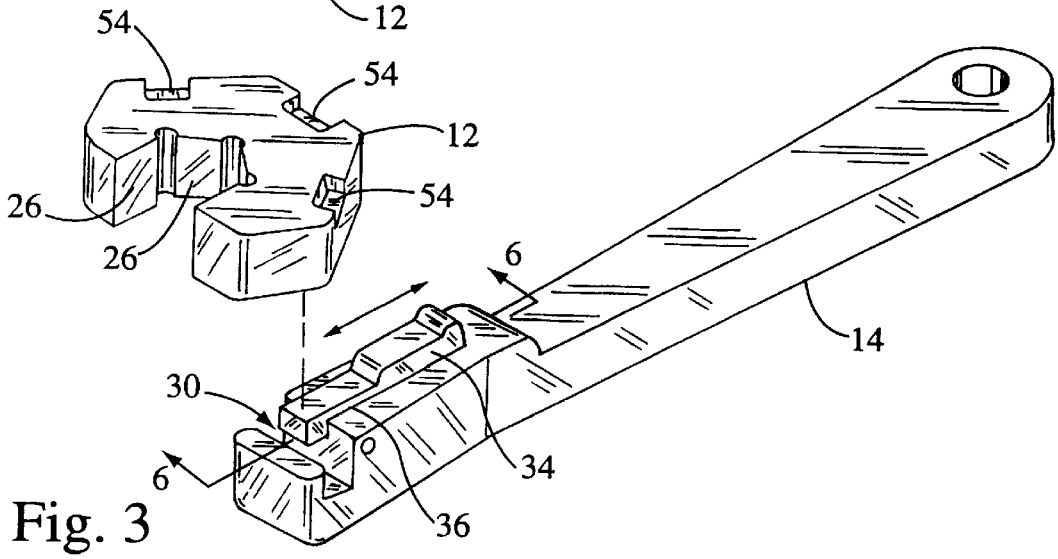
FIG. 3 is a bottom perspective view of the wrench shown in FIG. 1 with the handle detached from the wrench head.

The coupling of the wrench head 12 to handle 14 is assisted by a locking mechanism 34 that engages a complementary recess 52 formed on a side of wrench head 12 opposite to engagement portion 20. The locking mechanism 34 comprises a trigger 40 that is slidably attached to the handle 14 within a slot 36. The trigger 40 has a locking tab 44 that protrudes over the handle channel 30 when the trigger 40 is in a locked position, as seen in FIG. 6. When the trigger 40 is in an unlocked position, the locking tab 44 does not extend over the handle channel 30. The locking tab 44 is sized slightly smaller than the recess 52 such that when the trigger 40 is in the locked position and the handle 14 is engaged to the wrench head 12, the locking tab 44 is disposed within the recess 52. The trigger 40 further includes a finger slide portion 46 that is easily gripped by a finger of the user to slide the trigger 40 between the locked and unlocked positions. The trigger 40 is normally biased in the locked position by a spring 38 disposed within the slot 36. A retention pin 48 secures the trigger within the slot 36. As seen in FIG. 2, the retention pin 48 is inserted into a bore 50 formed within the handle 14. The trigger 40 is formed with a retention pin channel 51 having a longitudinal axis that is generally perpendicular to the axis of the retention pin 48. The retention pin channel 51 is an elongate oval such that the trigger 40 is slidable upon the retention pin 48, yet the trigger 40 and spring 38 are maintained within the slot 36. When the handle 14 and the wrench head 12 are engaged, the locking tab 44 is disposed within a respective recess 52 of the wrench head 12 thereby preventing the wrench head 12 from being removed from the handle 14. In order to remove the wrench head 12, the trigger 40 is slidably moved away from the wrench head 12 thereby removing the locking tab 44 from a respective recess 52. In order to attach the wrench head 12 to the handle 14, the trigger 40 must be slid away from the handle channel 30 in order to for handle lip 32 to fully engage wrench head channel 22.

Additional modifications and improvements of the present invention may also be apparent to those of ordinary skill in the art such as configuring the wrench head 12 to engage different types and shapes of fasteners. Thus, the particular combination of parts described and illustrated herein is intended to represent only a certain embodiment of the present invention, and is not intended to serve as a limitation of alternative devices within the spirit and scope of the invention.

What is claimed is:

1. A wrench for use with a fastener, comprising:

a wrench head having:

a retention opening for engaging the fastener; and at least two engagement portions, each of the engagement portions having a recessed head channel and a head lip; and an elongate handle having:

a handle lip receivable into the recessed head channel of one of the engagement portions; and a handle channel receivable of the head lip of one of the engagement portions, the handle lip and the handle channel facilitating releasable attachment of the handle to the wrench head.

2. The wrench of claim 1 wherein the handle further comprises a locking mechanism to assist in maintaining the handle in releasable attachment with the engagement portion.

3. The wrench of claim 2 wherein the locking mechanism comprises:

a biasing spring disposed within the handle; and a friction member disposed on one end of the biasing spring and normally biased against the head lip of one of the engagement portions.

4. The wrench of claim 1 wherein the retention opening includes an open end for allowing the wrench head to be laterally extensible over the fastener.

5. The wrench of claim 4 wherein the fastener is a six-sided hex head and the retention opening defines four sides for engaging corresponding sides of the hex head.

6. The wrench head of claim 1 wherein the wrench head includes three engagement portions positioned at equidistantly spaced intervals of from about 50 degrees to 55 degrees in order to facilitate attachment of the wrench head to the handle.

7. A method of providing torque to a fastener through the use of a wrench including a wrench head having a retention opening, a recessed head channel and a head lip, and an elongate handle having a handle lip and a handle channel, the method comprising the steps of:

a) placing the fastener within the retention opening;

b) engaging the handle lip of the handle with the head channel of the wrench head;

c) engaging the handle channel of the handle to the head lip of the wrench head; and d) rotating the handle to provide torque to the fastener.

8. The method of claim 7 wherein the wrench head includes at least two recessed head channels and two head lips and the method further comprises the steps of:

e) releasing the handle lip form the head channel;

f) releasing the handle channel from the head lip;

g) engaging the handle lip to another one of the head channels;

h) engaging the handle channel to another one of the head lips; and i) rotating the handle to provide torque to the fastener.

9. A wrench for use with a fastener, comprising:

a wrench head having at least two recessed head channels and a retention opening for engaging the fastener; and an elongate handle having a handle lip receivable into a respective one of the recessed head channels;

wherein the handle is attachable to the wrench head by engaging the handle lip to a respective one of the handle lips in order to facilitate releasable attachment of the handle to the wrench head.

10. The wrench of claim 9 wherein the retention opening includes an open end for allowing the wrench head to be laterally extensible over the fastener.

11. The wrench of claim 10 wherein the fastener is a six-sided hex head and the retention opening defines four sides for engaging corresponding sides of the hex head.

12. The wrench of claim 11 wherein the handle further comprises a locking mechanism to assist in maintaining the handle in releasable attachment to the wrench head.

13. The wrench of claim 12 wherein the locking mechanism comprises:

a biasing spring disposed within the handle; and a friction member disposed on one end of the biasing spring and normally biased against the wrench head.

14. The wrench of claim 9 wherein the wrench head includes three recessed head channels positioned at equidistantly spaced intervals of from about 50 to 55 degrees in order to facilitate attachment of the handle to the wrench head.

* * * * *